US007408474B2

(12) United States Patent
Frazier et al.

(10) Patent No.: US 7,408,474 B2
(45) Date of Patent: Aug. 5, 2008

(54) SENSOR DAMAGE INDICATOR AND METHOD

(75) Inventors: Jeremiah Daniel Frazier, Grand Junction, CO (US); Brian Christopher Kelly, Grand Junction, CO (US)

(73) Assignee: Leitner-Poma of America, Inc., Grand Junction, CO (US)

( * ) Notice: Subject to any disclaimer, the term of this patent is extended or adjusted under 35 U.S.C. 154(b) by 576 days.

(21) Appl. No.: 10/738,107

(22) Filed: Dec. 16, 2003

(65) Prior Publication Data

US 2005/0128095 A1 Jun. 16, 2005

(51) Int. Cl.
*G08B 21/00* (2006.01)

(52) U.S. Cl. ..... 340/635; 340/454; 340/540; 104/112; 104/117.1; 188/1.11 W; 188/1.11 L

(58) Field of Classification Search ..... 340/635, 340/540, 454, 686.2, 686.6; 73/86, 158; 104/178, 179, 125, 173.1, 173.2, 112, 117.1; 188/1.11 W, 1.11 L, 1.11 E; 200/61.18
See application file for complete search history.

(56) References Cited

U.S. PATENT DOCUMENTS

| | | | | |
|---|---|---|---|---|
| 3,628,136 | A | 12/1971 | Jonas | |
| 4,003,314 | A * | 1/1977 | Pearson | 104/307 |
| 4,047,434 | A | 9/1977 | Marsh et al. | |
| 4,067,225 | A | 1/1978 | Dorman et al. | |
| 4,271,763 | A * | 6/1981 | Berger | 104/179 |
| 4,462,314 | A * | 7/1984 | Kunczynski | 104/115 |
| 4,486,811 | A | 12/1984 | Kamiya et al. | |
| 4,568,873 | A | 2/1986 | Oyanagi et al. | |
| 4,655,077 | A * | 4/1987 | Purvis et al. | 73/86 |
| 4,760,326 | A | 7/1988 | Bird | |
| 4,766,368 | A | 8/1988 | Cox | |
| 5,528,219 | A * | 6/1996 | Frohlich et al. | 340/540 |
| 6,095,290 | A | 8/2000 | Takanashi | 188/1.11 L |
| 6,135,494 | A * | 10/2000 | Lotito et al. | 280/731 |
| 6,255,958 | B1 * | 7/2001 | Haimovich et al. | 340/686.6 |
| 6,393,995 | B1 | 5/2002 | Mugnier | |
| 6,720,873 | B1 * | 4/2004 | Tressler | 340/515 |

* cited by examiner

*Primary Examiner*—Davetta W. Goins
(74) *Attorney, Agent, or Firm*—Klaas, Law, O'Meara & Malkin, P.C.; Michael A. Goodwin, Esq.

(57) ABSTRACT

A damage indicator for indicating potential damage to a sensor.

24 Claims, 6 Drawing Sheets

SENSOR DAMAGE INDICATOR AND METHOD

BACKGROUND

Aerial ropeway transportation systems are utilized for moving objects, commonly people. Examples of aerial ropeway transportation system are ski-lifts, fixed and detachable chairlifts, gondolas, aerial tramways and skyrides.

Sensors (e.g. proximity sensors) are utilized in aerial ropeway transportation systems to monitor performance. These sensors can be damaged if they are struck by another object. A damaged sensor may effect operability of the aerial ropeway transportation system until the sensor is replaced.

SUMMARY

In one exemplary embodiment, methods and apparatus for indicating damage to a senor may include a sensor damage indicator including a frangible conductor.

In another exemplary embodiment, an exemplary sensor may include: a sensor conductor operably associated with the sensor; and a frangible conductor attached to the sensor conductor.

In another exemplary embodiment, a method of indicating impact to a sensor may include: providing a conductor operably associated with the sensor; and indicating the impact by monitoring the conductor.

In another exemplary embodiment, an aerial ropeway may include: a sensor; a signal conductor operably associated with the sensor; and an impact conductor attached to the signal conductor.

BRIEF DESCRIPTION OF THE DRAWING

The following Figures of the Drawing illustrate exemplary embodiments of the present sensor damage indicator.

DETAILED DESCRIPTION

Described herein are devices and methods for indicating damage to a sensor. These devices indicate that the sensor may have received a damaging impact from another object by monitoring a frangible conductor.

Figure 1:
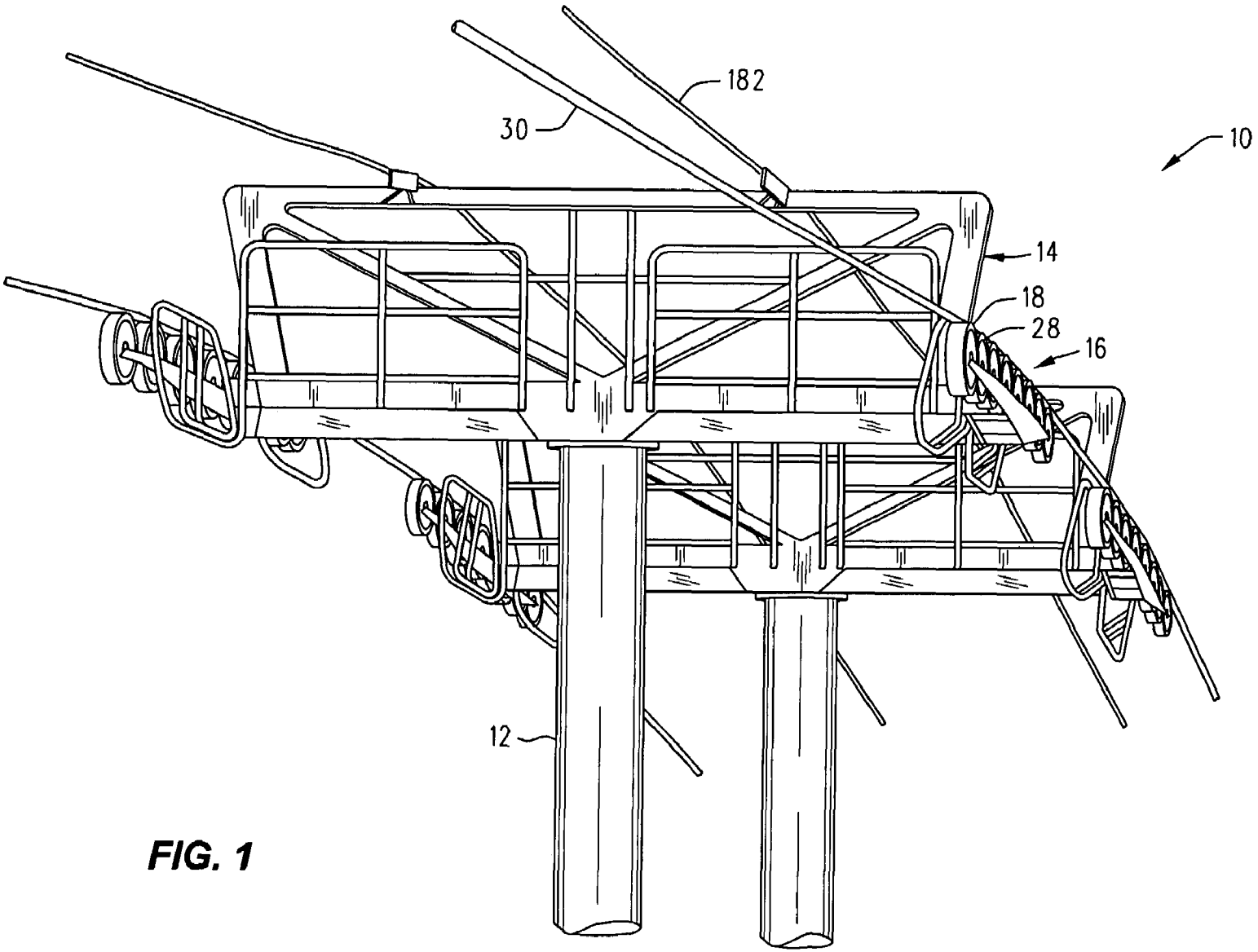
FIG. 1 is a perspective view of an exemplary type of aerial ropeway transportation system.

FIG. 1 shows one exemplary application for the damage indicator 100 (FIG. 4); this exemplary application is an aerial ropeway 10. With reference to FIG. 1, the aerial ropeway 10 may include a plurality of support towers (e.g. support tower 12) secured to earth at predetermined distances apart depending on application.

Each support tower, such as support tower 12, may be provided with a crossbar member 14 and a plurality of sheaves 16. The crossbar member 14 is somewhat rigidly attached to the support tower 12. The plurality of sheaves 16 (e.g. individual sheaves 18 and 28) are rotationally attached to the crossbar member 14.

The aerial ropeway 10 may be further provided with a haul rope cable 30. The haul rope cable 30 may be formed from any of a number of materials, however it is commonly manufactured from braided steel. The haul rope cable 30 may be supported by the plurality of sheaves 16 in a manner that allows the haul rope cable 30 to move relative to earth.

Figure 2:
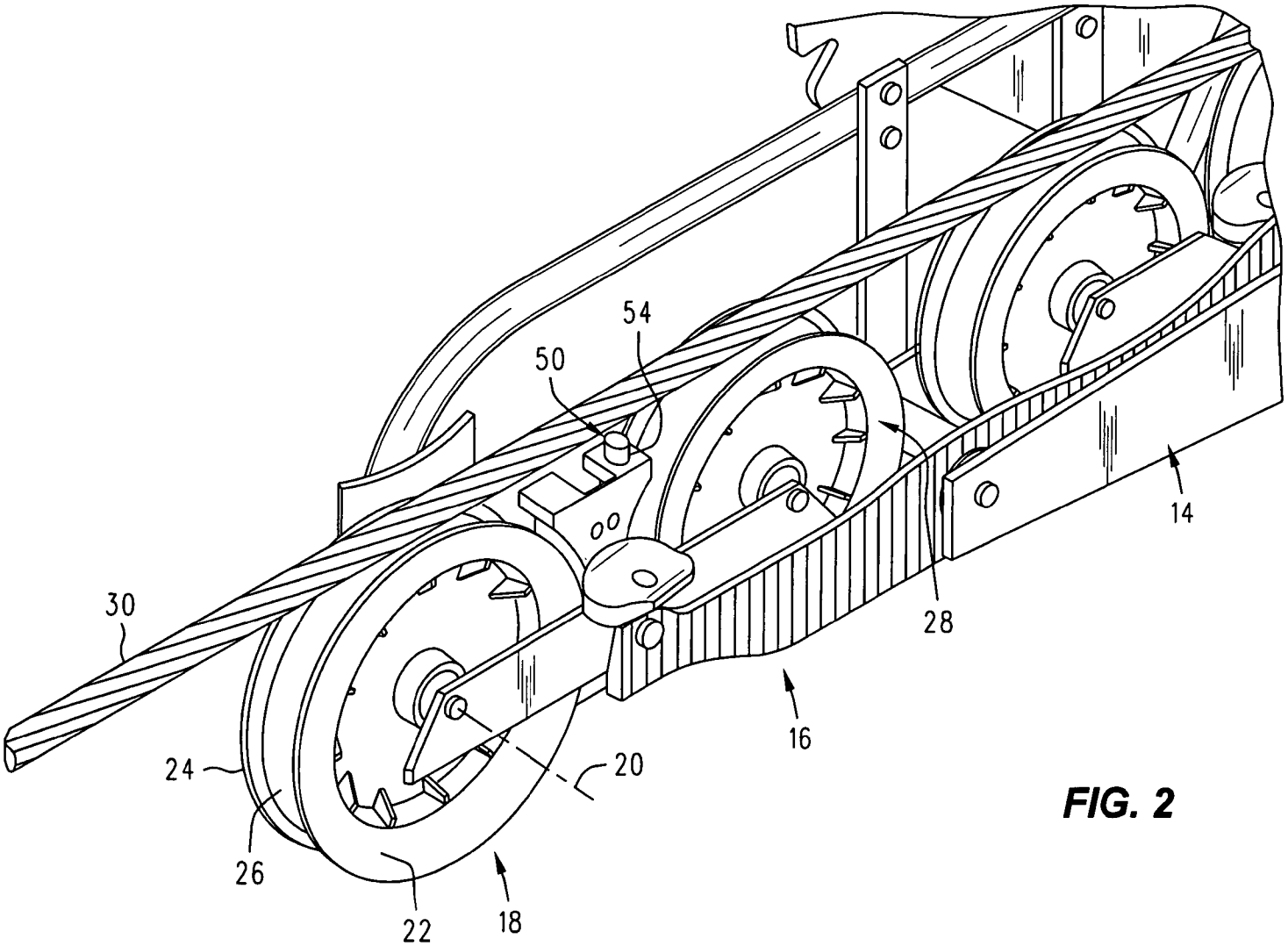
FIG. 2 is a perspective view of a plurality of sheaves of the aerial ropeway transportation system of FIG. 1.

FIG. 2 shows a magnified portion of the individual sheaves 18 and 28 attached to the crossbar member 14. It should be noted that the plurality of sheaves 16 may be substantially similar to each other; therefore, the following description of individual sheave 18 is adequate for describing other sheaves (e.g. individual sheave 18). With reference to FIG. 2, individual sheave 18 may be provided with a first axis 20, a first face 22, a second face 24 and a track 26. The first and second faces 22, 24 may take the form of circles formed parallel to and oppositely disposed from each other. The first axis 20 may be located at the center of the faces 22, 24. The track 26 may be formed as a semicircle and positioned concentric to the first axis 20. Furthermore, the semicircular configuration of the track 26 may accept the haul rope cable 30.

Figure 3:
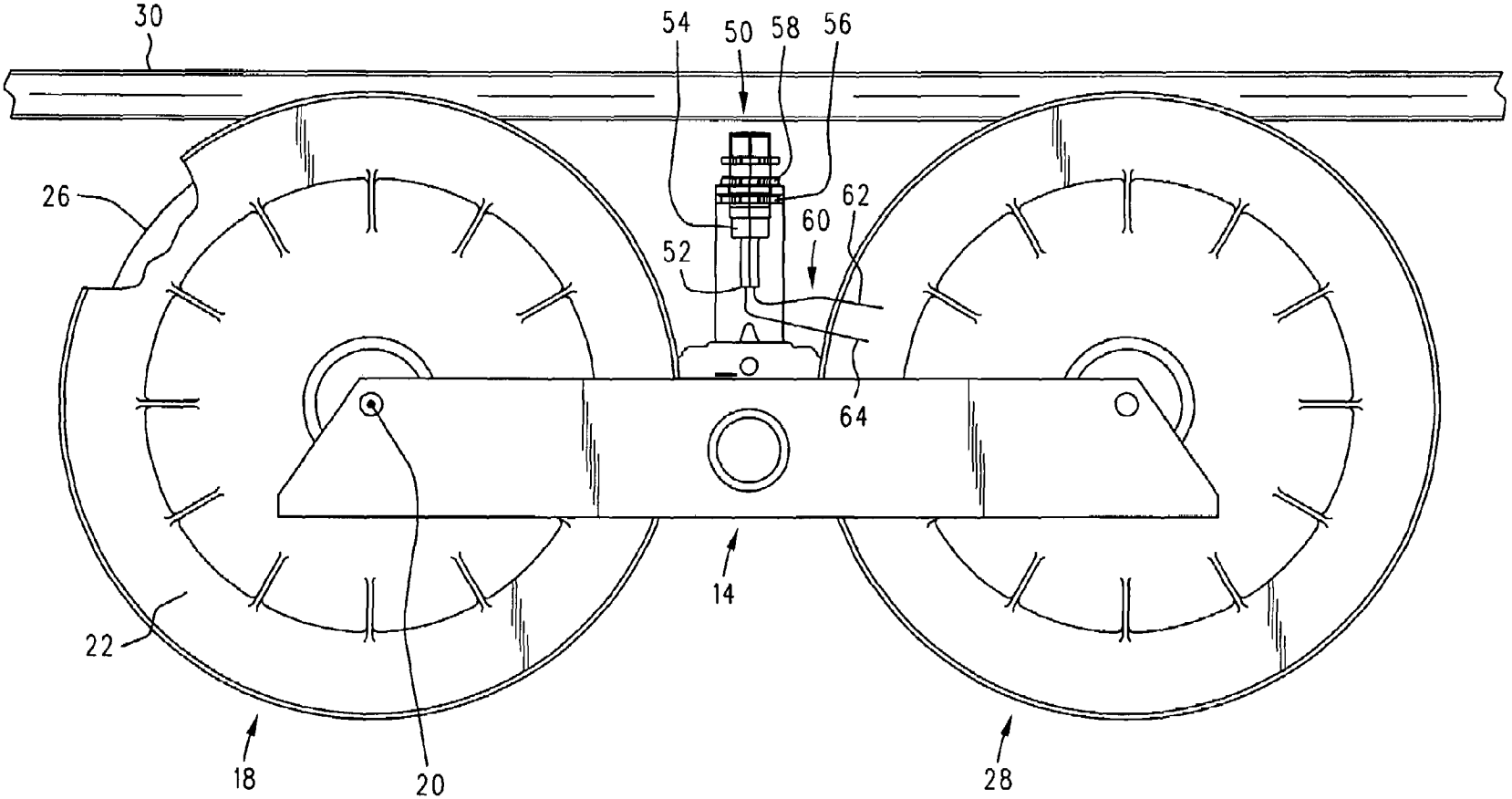
FIG. 3 is a side elevation view of the plurality of the sheaves of the aerial ropeway transportation system of FIG. 2.

FIG. 3 illustrates a side elevation view of the individual sheaves 18, 28. With reference to FIG. 3, the haul rope cable 30 contacts the plurality of sheaves 16 (e.g. individual sheave 18). In particular, individual sheave 18 contacts the haul roped cable 30 at the track 26.

With continued reference to FIG. 3, the aerial ropeway 10 may be provided with a cable positioning switch system 50. The cable positioning switch system 50 may be provided with a mounting bracket 52, a proximity sensor 54, a first nut 56 and a second nut 58. The mounting bracket 52 may be rigidly attached to the crossbar member 14. The proximity sensor 54 may be adjustably affixed to the mounting bracket 52 with the nuts 56, 58.

One exemplary type of proximity sensor 54 is an inductive proximity sensor that is a non-contact proximity sensor. One commercially available proximity sensor is manufactured by Allen-Bradley of Milwaukee, Wis. and identified by part number 871T-DX50-H2. Another commercially available proximity sensor is manufactured by Efector of Exton, Pa. and identified by part number 1B5163. The exemplary proximity sensor 54 creates a radio frequency field (RF) with an oscillator and a coil. An inductive proximity sensor 54 may include an LC oscillating circuit, a signal evaluator, and a switching amplifier. The coil of this oscillating circuit generates a high-frequency electromagnetic alternating field. This field is emitted at the sensing face of the proximity sensor 54. If a metallic object (e.g. haul rope cable 30) nears the sensing face, eddy currents are generated thereby drawing energy from the oscillating circuit and reducing the oscillations. The signal evaluator behind the LC oscillating circuit converts this information into a clear signal. Inductive proximity sensors 54 may switch an AC load or a DC load. DC load configurations can be NPN or PNP. NPN is a transistor output that switches the common or negative voltage to the load; load connected between proximity sensor output and positive voltage supply. PNP is a transistor output that switches the positive voltage to the load; load connected between sensor output and voltage supply common or negative. Wire configurations are 2-wire, 3-wire NPN, 3-wire PNP, 4-wire NPN, and 4-wire PNP.

Figure 4:
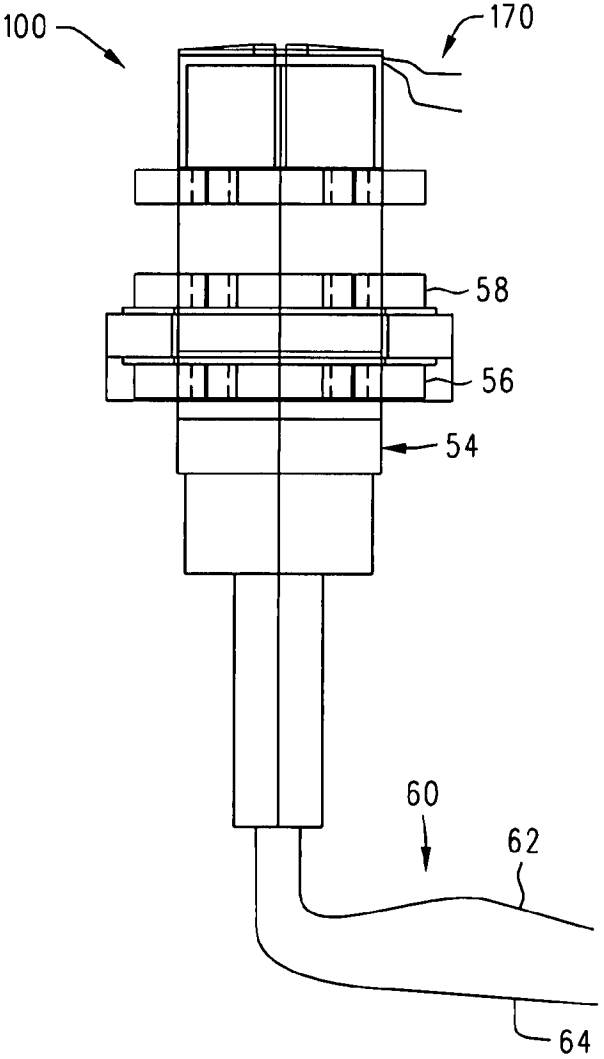
FIG. 4 is a side elevation view of an exemplary sensor provided with an exemplary damage indicator.

FIG. 4 illustrates a side elevation view of the proximity sensor 54. With reference to FIG. 4, the proximity sensor 54 is provided with electrical leads 60 such as first lead 62 and second lead 64. The illustrated embodiment shows a 2-wire configuration; it is to be understood that the present damage indicator 100 and methods associated therewith may be adapted to other types of fragile sensors. In a process that will be described later herein, the proximity sensor 54 may be mounted somewhat close to the haul rope cable 30 as illustrated in FIG. 3. With reference to FIG. 3, if the haul rope cable 30 moves from the track 26, the proximity sensor 54 generates a signal indicating this movement. In some cases, movement of the haul rope cable 30 may reduce operability of the aerial ropeway 10.

With continued reference to FIG. 3, the location of the proximity sensor 54 renders it vulnerable to being damaged. One form of damage to the proximity sensor 54 is an impact (by objects such as, for example, ice, tools, ladders, brackets, etc.) to the proximity sensor 54. The previously-described internal components of the proximity sensor 54 are somewhat fragile. If these internal components are damaged by an impact, the proximity sensor 54 may send erroneous information about the location of the haul rope cable 30. In order to reduce the risk of sending erroneous information about the location of the haul rope cable 30, the present sensor damage indicator 100 may be incorporated into (or alternatively attached to) the proximity sensor 54.

Figure 5:
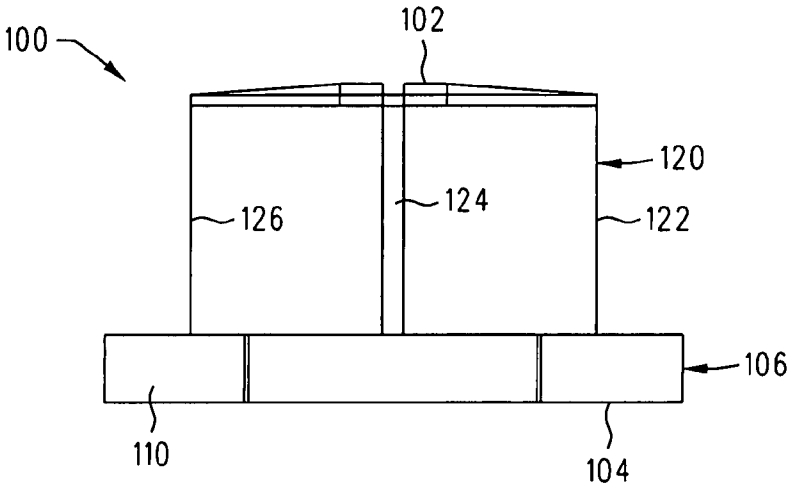
FIG. 5 is a side elevation view of the exemplary damage indicator of FIG. 4.

With reference to FIG. 4, the damage indicator 100 may be positioned on the proximity sensor 54. FIG. 5 illustrates a side elevation view of the damage indicator 100 of FIG. 4. With reference to FIG. 5, the damage indicator 100 may be provided with a top portion 102 and an oppositely disposed bottom portion 104. The bottom portion 104 may be formed as a threaded nut 106. The threaded nut 106 may be provided with a threaded portion 108 (FIG. 6) formed on the interior portion thereof. The threaded nut may also be provided with a flat-surfaced potion 110 formed on the exterior portion thereof.

Figure 6:
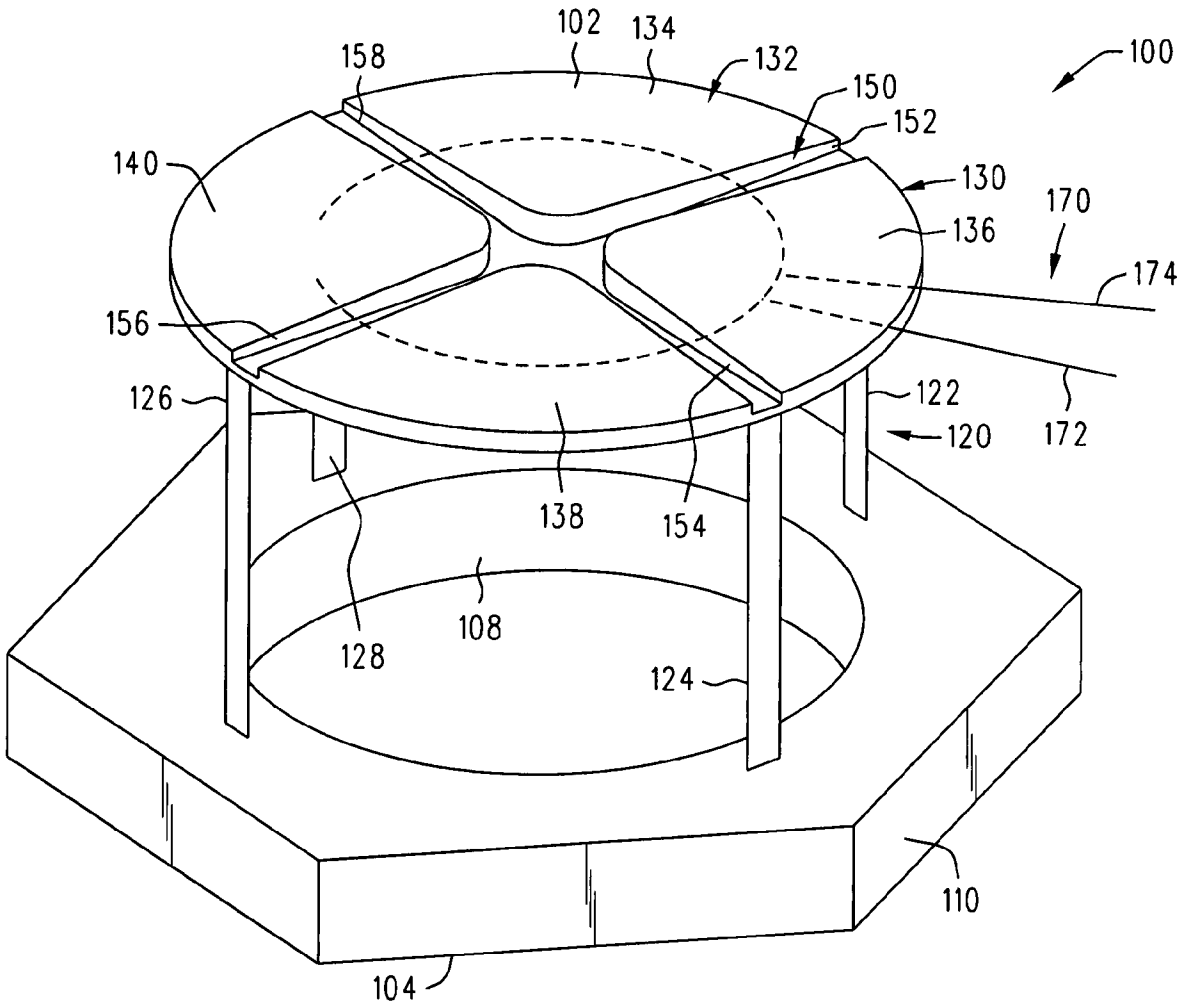
FIG. 6 is a perspective view of the exemplary damage indicator of FIG. 5.

FIG. 6 illustrates a perspective view of the damage indicator 100. With reference to FIG. 6, the damage indicator 100 may be further provided with a plurality of stanchions 120 such as first stanchion 122, second stanchion 124, third stanchion 126 and fourth stanchion 128. The stanchions 120 may protrude from the threaded nut 106 formed at the bottom portion 104 towards the top portion 102 as illustrated in FIG. 6.

With continued reference to FIG. 6, the damage indicator 100 may be provided with a plate 130. The plate 130 may be attached to (or integrally formed with) the stanchions 120. The plate 130 may be provided with a plurality of crush zones 132 such as first crush zone 134, second crush zone 136, third crush zone 138 and fourth crush zone 140. The plate 130 may be further provided with a plurality of frangible lines 150 such as first frangible line 152, second frangible line 154, third frangible line 156 and fourth frangible line 158. The first frangible line 152 may separate the first and second crush zones 134, 136. The second frangible line 154 may separate the second and third crush zones 136, 138. The third frangible line 156 may separate the third and fourth crush zones 138, 140. The fourth frangible line 158 may separate the fourth and first crush zones 140, 134. These frangible lines 150 may, for example, be areas where material is removed from the plate 130 (e.g. the frangible lines 150 may be detents molded into the plate 130 when manufactured).

With continued reference to FIG. 6, the damage indicator 100 may be further provided with a frangible conductor 170. This frangible conductor 170 may be composed of any conductor such as, for example, copper wire, conductor paths on printed circuit board, silver wire, metallic wire of any type, etc. In one exemplary embodiment, the frangible conductor 170 may be wire between 22 to 18 American Wire Gage (0.0253-0.0403 inches in diameter). The frangible conductor 170 may define a first end 172 and a second end 174. The frangible conductor 170 may be attached to (or integrally formed with) the plate 130 as illustrated, for example, in the exemplary pattern indicated by the dashed line in FIG. 6. It should be noted that as illustrated in FIG. 6, the frangible conductor 170 may overlap frangible portions of the damage indicator 100 (e.g. the frangible lines 150).

Figure 7:
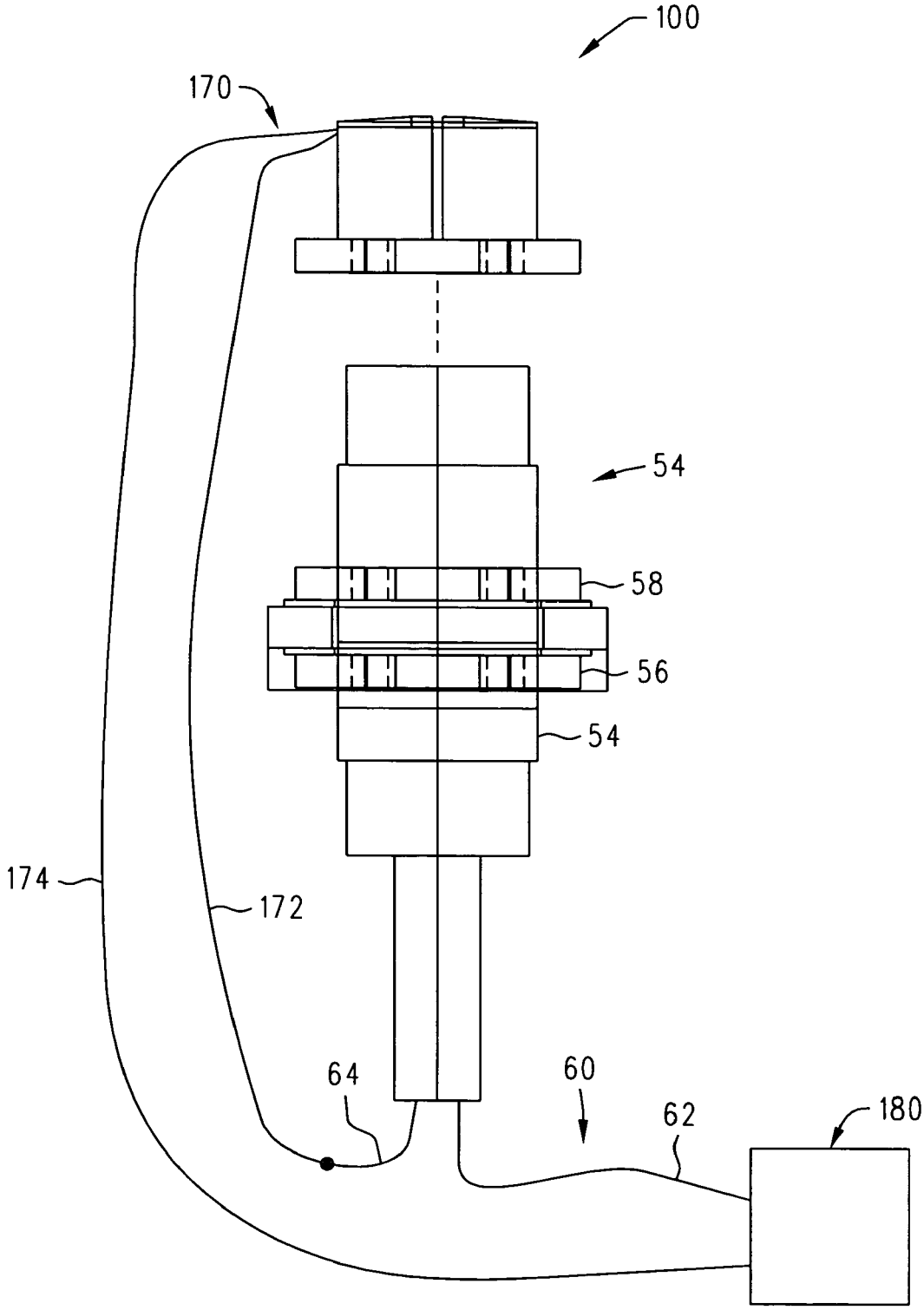
FIG. 7 is an exemplary wiring diagram for the exemplary sensor and exemplary damage indicator of FIG. 4.

With reference to FIG. 7, the aerial ropeway 10 (FIG. 1) may be further provided with a cabinet 180. The cabinet 180 may be provided with a high voltage side and a low voltage side. The high voltage side may include high-power components such as a main circuit breaker, a main contactor, a regenerative bridge, etc. The low voltage side may include low-power components that control and monitor all the functions of the aerial ropeway 10. Examples of low-power components include, but are not limited to, the cable positioning switch system 50 (FIG. 3), derailment detectors, stop buttons, end-track device safeties returns, anemometers, wind vanes, telephone and any other information transmission devices, are connected through these wires to the cabinet 180. These various low-power components may be connected to the cabinet 180 through wires located in a communication cable 182 (FIG. 1).

Having provided detailed descriptions of exemplary components of the present damage indicator 100, an exemplary assembly thereof will now be provided. FIG. 7 illustrates one exemplary assembly and wiring configuration for the damage indicator 100 and the proximity sensor 54. With reference to FIG. 7, the damage indicator 100 may be threadingly engaged to the proximity sensor 54. This engagement may occur by rotating the damage indicator 100 while contacting the proximity sensor 54 to cause the threaded portion 108 (FIG. 6) of the damage indicator 100 to capture the proximity sensor 54. The resulting combination of the damage indicator 100 and the proximity sensor 54 is illustrated in FIG. 4.

With continued reference to FIG. 7, after physically assembling the damage indicator 100 to the proximity sensor 54, the electrical components thereof may be attached. It should be noted that the following description of wiring is provided for illustrative purposes only and that other wiring approaches may be utilized (e.g. the proximity sensor 54 may be of the three-wire type, the damage indicator 100 may be direct-wired to the cabinet 180, etc.). The first lead 62 of the proximity sensor 54 may be electrically interfaced with the cabinet 180. The second lead 64 of the proximity sensor 54 may be electrically interfaced with the first end 172 of the frangible conductor 170. The second end 174 of the frangible conductor 170 may be electrically interfaced with the cabinet 180. It is to be understood that this electrical interfacing may occur through various electrical components such as, for example, bus bars, wires, the communications cable 182 (FIG. 1), etc.

When utilized to indicate damage to the proximity sensor 54, the damage indicator 100 may be utilized as an 'impact fuse'. As used herein, the term impact fuse describes any device capable of indicating to the cabinet 180 (controller) that the proximity sensor 54 has been impacted. As illustrated herein, the impact fuse may take the form of the damage indicator 100 illustrated in the figures of the drawing as well as other embodiments not illustrated in the drawing.

When the proximity sensor 54 is impacted, the plate 130 will rupture. This rupture may occur, for example, at the frangible lines 150. This rupturing of the plate 130 causes the frangible conductor 170 to break (thereby disrupting the conductivity of the frangible conductor). Therefore, before the impact, an indicator signal may travel from the first end 172 to the second end 174 of the frangible conductor 170 (sometime referred to herein as a first condition of the damage indicator). After impact, the indicator signal cannot travel along the frangible conductor 170 (sometime referred to herein as a second condition of the damage indicator). This disruption of the indicator signal may be detected by the circuitry within the cabinet 180 (FIG. 7).

In one exemplary application illustrated in FIG. 1, the aerial ropeway 10 is operated to move objects from one location to another location. In order to move objects, the haul rope cable 30 moves with respect to the support tower 12. The moving haul rope cable 30 is supported by the plurality of sheaves 16.

With reference to FIG. 2, as individual sheave 18 supports the haul rope cable 30, the sheave 18 rotates about the first axis 20. In normal operating conditions, the first face 22, the second face 24 and the track 26 of the sheave 18 support the haul rope cable 30. Due to a variety of circumstances, the haul rope cable 30 may become misaligned and improperly supported by the sheave 18. One such misalignment is the separation of the haul rope cable 30 from the track 26. The cable positioning switch system 50 may sense this misalignment of the haul rope cable 30 and notify the cabinet 180 (FIG. 7). The cabinet 180 may invoke notification and/or take action accordingly.

In some circumstances, the proximity sensor 54 of the cable positioning system 50 may be damaged. The proximity sensor 54 may, for example, be damaged by the haul rope cable 30 impacting the proximity sensor 54. In some circumstances, this damage may cause the proximity sensor 54 to report (via the cable positioning switch system 50) to the cabinet 180 the haul rope cable 30 is misaligned. However, in other circumstances, this damage may cause the proximity sensor 54 to incorrectly report that the system is properly positioned (even though the haul rope cable 30 is misaligned).

With reference to FIG. 3, when the present damage indicator 100 is employed in the previously described situation, the damage to the proximity sensor 54 is reported to the cabinet 180 (via the damage indicator 100). As previously described, when the damage indicator 100 receives an impact (for example, an impact from the haul rope cable 30), the frangible conductor 170 (FIG. 6) is ruptured. The ruptured frangible conductor 170 is not able to transmit the indicator signal from the first end 172 to the second end 174. The cabinet 180 may take action(s) to indicate this damage to the proximity sensor 54. Therefore, use of the present damage indicator 100 improves proper operation of the aerial ropeway 10 by indicating impact to the proximity sensor 54.

In one alternative embodiment, the damage indicator 100 may be provided with crush zones 132 and/or the frangible lines 150 may be formed having varying thickness. In one varying-thickness alternative, the crush zones 132 may be relatively thick near a center of the plate 130 and relatively thin near an outer perimeter of the plate 130. This alternative allows the frangible conductor 170 to rupture should the impact be from a side rather than directly on top of the damage indicator 100.

In another alternative embodiment, the main body of the damage indicator 100 may be composed of a non-conducting material such as, for example, plastic. In this plastic-damage indicator embodiment, the components (e.g. plate 130) may be relatively "invisible" to the proximity sensor 54.

In another alternative embodiment, the damage indicator 100 may be provided with a plate 130 configured as an envelope in which a conductive fluid is retained. The conductive fluid may conduct current in a manner similar to the frangible wire 170. If the plate 130 (configured with conductive fluid disposed therein) ruptures due to an impact, the sensor signal would not travel through the damage indicator 100. This non-conduction of the sensor signal indicates that the proximity sensor 54 may be damaged.

In another alternative embodiment, the damage indicator 100 may be provided with the plate 130 be formed as an air-tight enclosure through which the frangible wire 170 may extend. In this alternative embodiment, the air-tight enclosure may have a vacuum applied thereto. In the event that the plate 130 is ruptured, the vacuum is lost. With a loss in vacuum, air may contact the frangible wire 170, thereby causing it to rupture. This alternative embodiment is similar to an incandescent light bulb wherein a filament (e.g. tungsten) ruptures if it is exposed to air.

While illustrative and presently preferred embodiments have been described in detail herein, it is to be understood that the inventive concepts may be otherwise variously embodied and employed and that the appended claims are intended to be construed to include such variations except insofar as limited by the prior art.

What is claimed is:

1. A method comprising:

providing a first sensor;

providing a second sensor adjacent said first sensor;

monitoring said first sensor to detect impact to said second sensor;

providing a ropeway system comprising a cable;

positioning said second sensor adjacent said cable and said first sensor between said cable and said second sensor.

2. The method of claim 1 and further wherein:

said first sensor comprises at least one electrically-conductive member;

said monitoring comprises monitoring the electrical continuity of said electrically-conductive member.

3. The method of claim 2 and further wherein said at least one electrically-conductive member is frangible.

4. The method of claim 1 and further comprising:

detecting said cable with said second sensor.

5. A system comprising:

a first sensor;

a second sensor adjacent said first sensor;

said first sensor comprising at least one frangible electrically-conductive member;

a ropeway comprising a cable; and wherein, said second sensor is located adjacent said cable and said first sensor is located between said cable and said second sensor.

6. The system of claim 5 and further wherein said first sensor further comprises a plate to which said electrically-conductive member is attached.

7. The system of claim 6 and further wherein said first sensor further comprises:

at least one frangible line formed in said plate; and wherein said electrically-conductive member crosses said frangible line.

8. The system of claim 7 wherein said first sensor further comprises:

a second frangible line formed in said plate; and wherein said electrically-conductive member crosses said second frangible line.

9. The system of claim 6 wherein said first sensor further comprises:

at least one crush zone formed in said plate.

10. The system of claim 9 and further wherein said crush zone varies in thickness.

11. The system of claim 5 and further wherein said second sensor is attached to said first sensor.

12. The system of claim 5 and further wherein said second sensor is a proximity sensor.

13. A ropeway system comprising:

a cable;

a first sensor adjacent said cable;

said first sensor comprising at least one electrically-conductive frangible element;

wherein said first sensor further comprises a plate to which said electrically-conductive member is attached and at least one frangible line formed in said plate; and wherein said electrically-conductive member crosses said frangible line.

14. The system of claim 13 wherein said first sensor further comprises:

a second frangible line formed in said plate; and wherein said electrically-conductive member crosses said second frangible line.

15. The system of claim 13 wherein said first sensor further comprises:

at least one crush zone formed in said plate.

16. The system of claim 15 and further wherein said crush zone varies in thickness.

17. The system of claim 13 and further comprising:

a second sensor;

wherein, said second sensor is located adjacent said cable and said first sensor is located between said cable and said second sensor.

18. The system of claim 17 and further wherein said second sensor is attached to said first sensor.

19. The system of claim 17 and further wherein said second sensor is a proximity sensor.

20. A system comprising:

a first sensor;

a second sensor adjacent said first sensor;

said first sensor comprising at least one frangible electrically-conductive member;

wherein said second sensor is a proximity sensor;

wherein said first sensor further comprises a plate to which said electrically-conductive member is attached;

wherein said first sensor further comprises:

at least one frangible line formed in said plate; and wherein said electrically-conductive member crosses said frangible line.

21. The system of claim 20 wherein said first sensor further comprises:

a second frangible line formed in said plate; and wherein said electrically-conductive member crosses said second frangible line.

22. The system of claim 20 wherein said first sensor further comprises:

at least one crush zone formed in said plate.

23. The system of claim 22 and further wherein said crush zone varies in thickness.

24. The system of claim 20 and further wherein said second sensor is attached to said first sensor.

* * * * *